US006113045A

United States Patent [19]

Kuo

[11] Patent Number: 6,113,045

[45] Date of Patent: Sep. 5, 2000

[54] FITTING ADAPTED FOR HOLDING SPACEDLY A SUPPORT MEMBER ON AN UPRIGHT WALL

[76] Inventor: Kuo-Yung Kuo, No. 1, Alley 85, Lane 816, Chung-Shan Rd., Shen-Kang Hsiang, Taichung Hsien, Taiwan

[21] Appl. No.: 09/234,519

[22] Filed: Jan. 20, 1999

[51] Int. Cl.[7] ..... A47B 96/06

[52] U.S. Cl. ..... 248/222.14; 248/251; 248/224.7; 211/105

[58] Field of Search ..... 248/222.14, 251, 248/223.31, 224.7, 224.8, 231.9, 201; 211/105.1, 123; 403/362

[56] References Cited

U.S. PATENT DOCUMENTS

| | | | |
|---|---|---|---|
| 1,934,911 | 11/1933 | Campbell | 248/221.14 |
| 1,997,686 | 4/1935 | Hoegger | 248/222.14 |
| 2,542,941 | 2/1951 | Post | 248/205.1 |
| 2,590,410 | 3/1952 | Hurley | 248/206.3 |
| 5,076,523 | 12/1991 | Wang | 248/222.1 |
| 5,664,751 | 9/1997 | Lan | 248/251 |
| 5,799,804 | 9/1998 | Sharpe | 211/105.1 |
| 5,875,903 | 3/1999 | Chen | 211/105.1 |

*Primary Examiner*—Leslie A. Braun
*Assistant Examiner*—Gwendilyn Baxter
*Attorney, Agent, or Firm*—Skjerven, Morrill, MacPherson, Franklin & Friel LLP

[57] ABSTRACT

A fitting includes a positioning plate and a holding member connected to the positioning plate by an elongate mounting post. The positioning plate has an outer major wall to serve as a faceplate, and a bore extending from a central area of the outer major wall in an axial direction towards an upright wall, and having inner distal and proximate annular walls fixed on the upright wall by a screw fastener. The mounting post has a mounting portion threadedly engaging the inner distal annular wall, an opposite guiding portion, and an anchoring portion therebetween. The holding member has an axial hole to receive rotatably the guiding and anchoring portions, a skirt portion for concealing the anchoring portion, and a holding portion for holding a support member. A fastening member fixes the holding member relative to the anchoring portion by tightening along a radial direction relative to the axial direction. By means of the mounting post, the holding member is connected to the positioning plate firmly. Moreover, the mounting post can conceal the screw fastener in the positioning plate so as to protect the same from moisture.

5 Claims, 9 Drawing Sheets

FITTING ADAPTED FOR HOLDING SPACEDLY A SUPPORT MEMBER ON AN UPRIGHT WALL

BACKGROUND OF THE INVENTION

1. Field of the Invention

This invention relates to a fitting, more particularly to a fitting adapted for holding spacedly a support member, such as a transverse rod or a holding ring, on an upright wall.

2. Description of the Related Art

Referring to FIG. 1, a conventional fitting 10 is shown to include a disc-shaped faceplate 11, a positioning plate 12, and a holding member 13. The positioning plate 12 is mounted fixedly on an upright wall (not shown) by fastening members 16. The holding member 13 has a connecting portion 131 with an axial screw hole 132 and a holding portion with a holding hole 133 for holding a support member (not shown). A screw 15 passes through a central hole 115 in the faceplate 11 and is inserted threadedly into the screw hole 132 to fasten the holding member 13 on an outer major surface of the faceplate 11 such that the holding member 13 extends transversely from the outer major surface. The faceplate 11 has an engaging seat 111 with an inner wall 113 for engaging an engaging plate portion 121 of the positioning plate 12. The faceplate 11 is fastened to the positioning plate 12 by a fastening screw 14 which extends through a peripheral wall 114 of the faceplate 11 so as to anchor on an anchoring portion 122 of the positioning plate 12.

However, only the screw 15 is used to engage the holding member 13 with the faceplate 11, thereby resulting in unsteady engagement and possible swaying of the holding member 13. In addition, there is no waterproof structure between the connecting portion 131 and the faceplate 11, thereby resulting in rusting of the screws 14,15,16. Moreover, at least two screws 16 are needed to fix the positioning plate 12 on the upright wall.

SUMMARY OF THE INVENTION

The object of the present invention is to provide a fitting which can ensure firm engagement between a holding member and a positioning plate, and which can be adequately protected from moisture.

According to this invention, a fitting includes a positioning plate, an elongate mounting post, a holding member, and a fastening member. The positioning plate has an outer major wall to serve as a faceplate. A bore extends from the outer major wall in an axial direction towards an upright wall, and has an inner distal annular wall and an inner proximate annular wall opposite to the inner distal annular wall in the axial direction for fixing the positioning plate on the upright wall via a screw fastener. The mounting post has a mounting portion for threadedly engaging with the inner distal annular wall to form an integrity of the faceplate with the outer major wall, a guiding portion opposite to the mounting portion, and an anchoring portion interposed between the mounting and guiding portions. The holding member has an axial hole to receive rotatably the guiding and anchoring portions, a skirt portion which is brought to conceal the anchoring portion, and a holding portion for holding a support member. The fastening member is disposed to fix the holding member relative to the anchoring portion by tightening along a radial direction relative to the axial direction. As such, by means of the mounting post, the holding member is connected to the positioning plate firmly.

Moreover, the mounting post can conceal the screw fastener in the positioning plate to protect the same from moisture.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
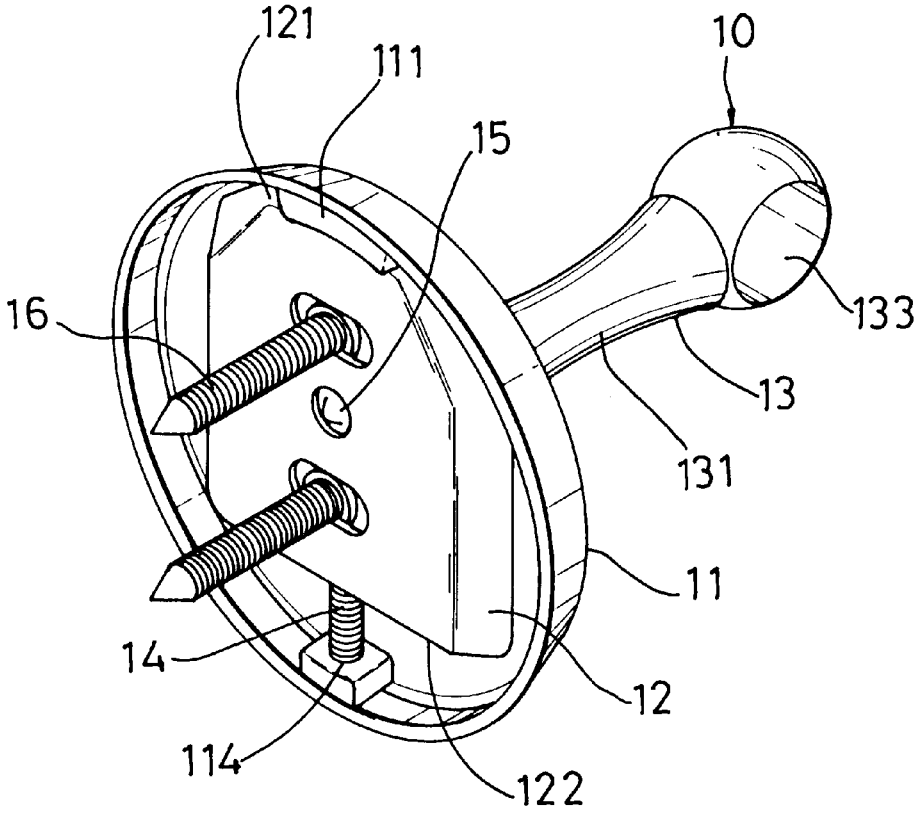
FIG. 1 PRIOR ART
FIG. 1 is a perspective view of a conventional fitting.
Figure 2:
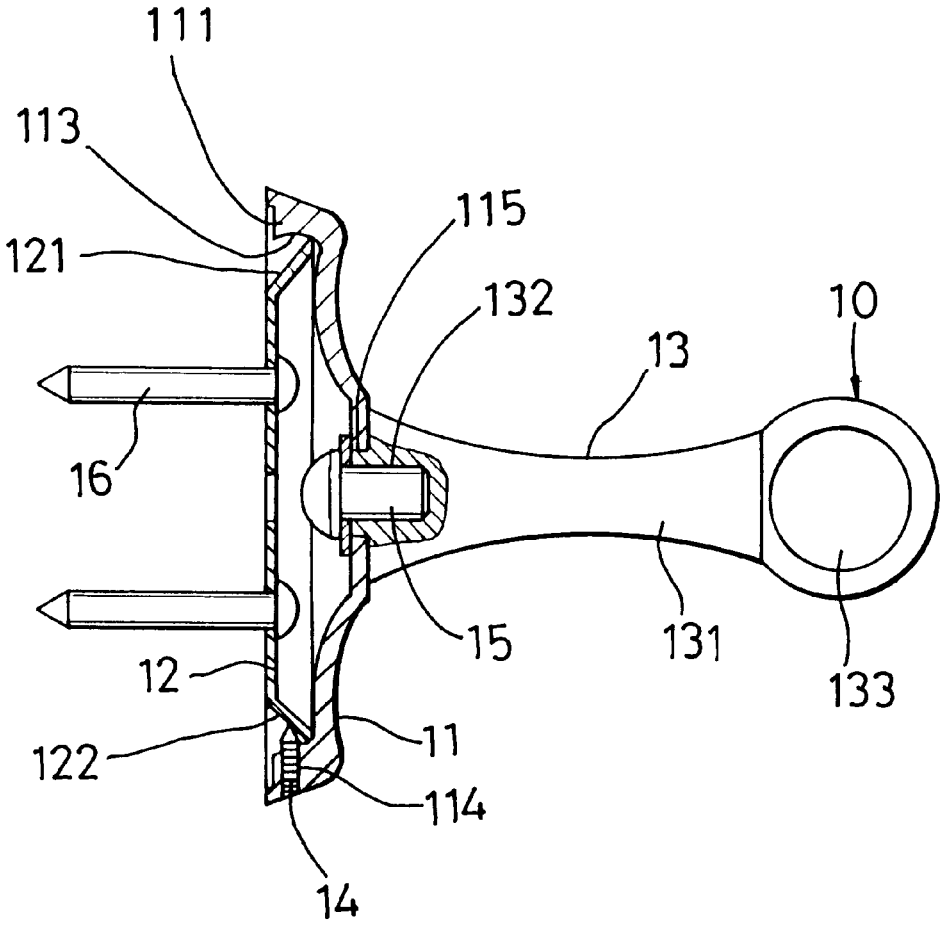
FIG. 2 PRIOR ART
FIG. 2 is a sectional view of the conventional fitting.

Before the present invention is described in greater detail, it should be noted that same reference numerals have been used to denote like elements throughout the specification.

Figure 3:
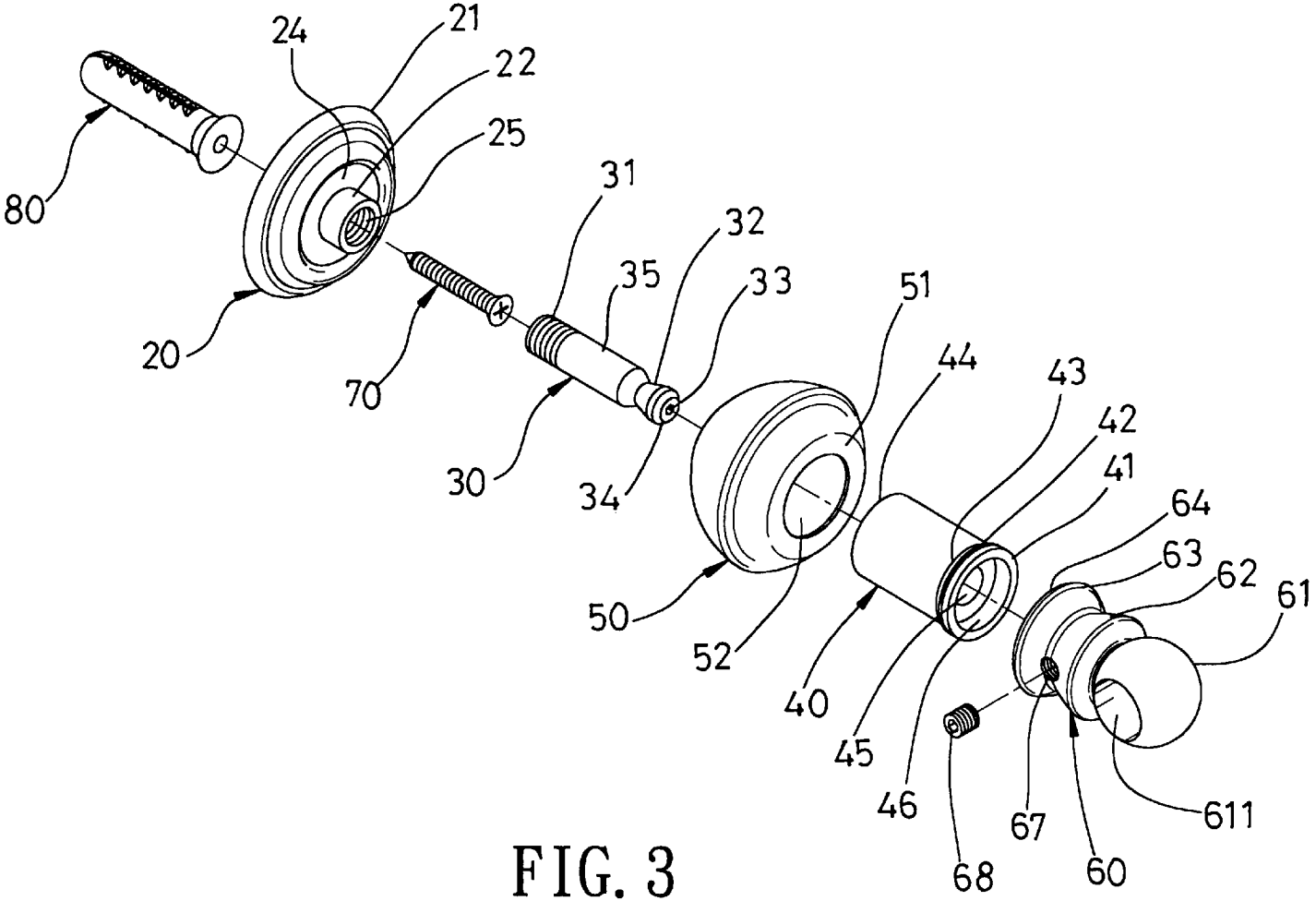
FIG. 3 is an exploded view of a preferred embodiment of a fitting according to this invention.
Figure 5:
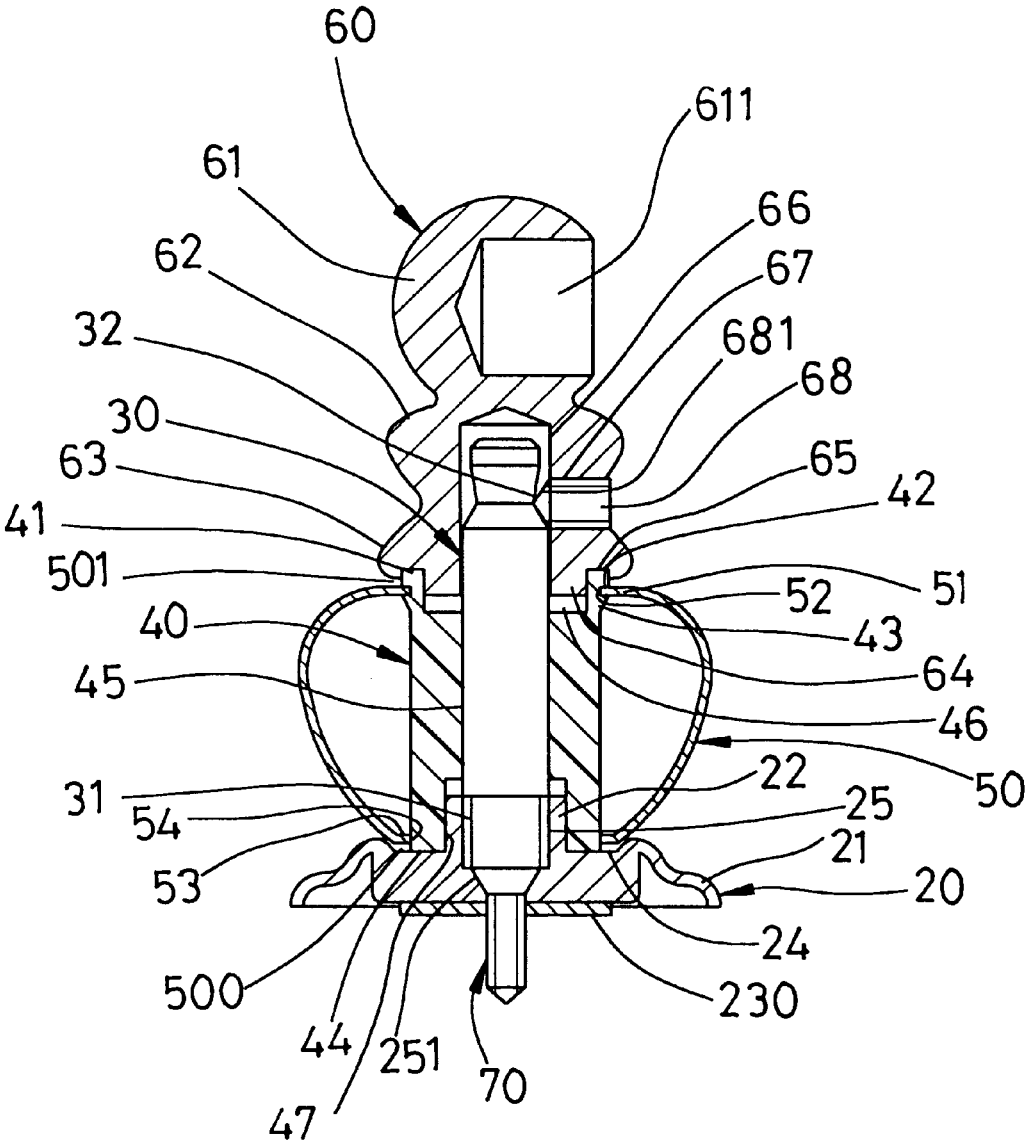
FIG. 5 is a sectional view of the preferred embodiment.

Referring to FIGS. 3 and 5, the preferred embodiment of the fitting according to the present invention is shown to comprise a positioning plate 20, an elongate mounting post 30, a hollow annular waterproof member 40, an annular shell member 50, and a holding member 60.

The positioning plate 20 includes a plate member 21 with an outer major wall which serves as a faceplate and which confines a central area 24, and a protruding post 22 which extends in an axial direction from the central area 24. A bore extends from the protruding post 22 in the axial direction toward an upright wall (not shown), and has an inner distal annular wall 25 which is tapped and proximate to the protruding post 22, and an inner proximate annular wall 251 which is disposed in the plate member 21 and which is communicated with the inner distal annular wall 25 so as to define a bottom hole such that a screw fastener 70 passes through the bottom hole for insertion into the upright wall to secure the positioning plate 20 on the upright wall along the axial direction.

The mounting post 30 is elongated in the axial direction, and has a mounting portion 31, a guiding portion 34 opposite to the mounting portion 31, an anchoring portion 32 which is interposed between the mounting and guiding portions 31,34, and a stem portion 35 which is interposed between the mounting and anchoring portions 31,32. The mounting portion 31 has a threaded outer surface for threadedly engaging with the inner distal annular wall 25 to conceal the bottom hole so as to form an integrity of the faceplate with the outer major wall. An operating hole 33 is formed in the guiding portion 34 for engaging a tool, such as a spanner (not shown), to rotate the mounting post 30.

The waterproof member 40 is made of a waterproof material, and is elongated in the axial direction. The waterproof member 40 has an axial hole 45, and proximate and distal annular recesses 47,46 which respectively extend inwardly of a proximate end 44 and a distal end 41 of the waterproof member 40. The proximate and distal annular recesses 47,46 have dimensions larger than that of the axial hole 45 and are communicated with the axial hole 45. In addition, the waterproof member 40 further has an annular neck portion 42 adjacent to the distal end 41, and an annular inclined wall 43 flanking immediately the neck portion 42.

The shell member 50 has two opposite distal and proximate neck portions 51,53 with distal and proximate engaging inner walls 52, 54, respectively, and a length which is slightly smaller than that of the waterproof member 40. The distal neck portion 51 is connected to the neck portion 42 with the guidance of the inclined wall 43, while the proximate neck portion 53 is connected to the waterproof member 40 adjacent to the proximate end 44.

The holding member 60 has an axial hole 66 to receive rotatably the guiding and anchoring portions 34,32 of the mounting post 30, an annular protrusion 64 proximate to the distal end 41 of the waterproof member 40 to be received in the distal annular recess 46 of the waterproof member 40, a skirt portion 63 which extends outwardly of the annular protrusion 64, a holding portion 61 distal to the annular protrusion 64, and a middle portion 62 which is interposed between the skirt portion 63 and the holding portion 61. An annular groove 65 is formed between the skirt portion 63 and the annular protrusion 64 so as to engage the distal end 41 of the waterproof member 40. A screw hole 67 is formed between the middle portion 62 and the skirt portion 63, and extends in a radial direction relative to the axial direction to be communicated with the axial hole 66. In addition, a holding hole 611 is formed through and extends in a direction transverse to the axial direction.

The fastening member 68, such as a screw fastener, is inserted threadedly into the screw hole 67.

Figure 4:
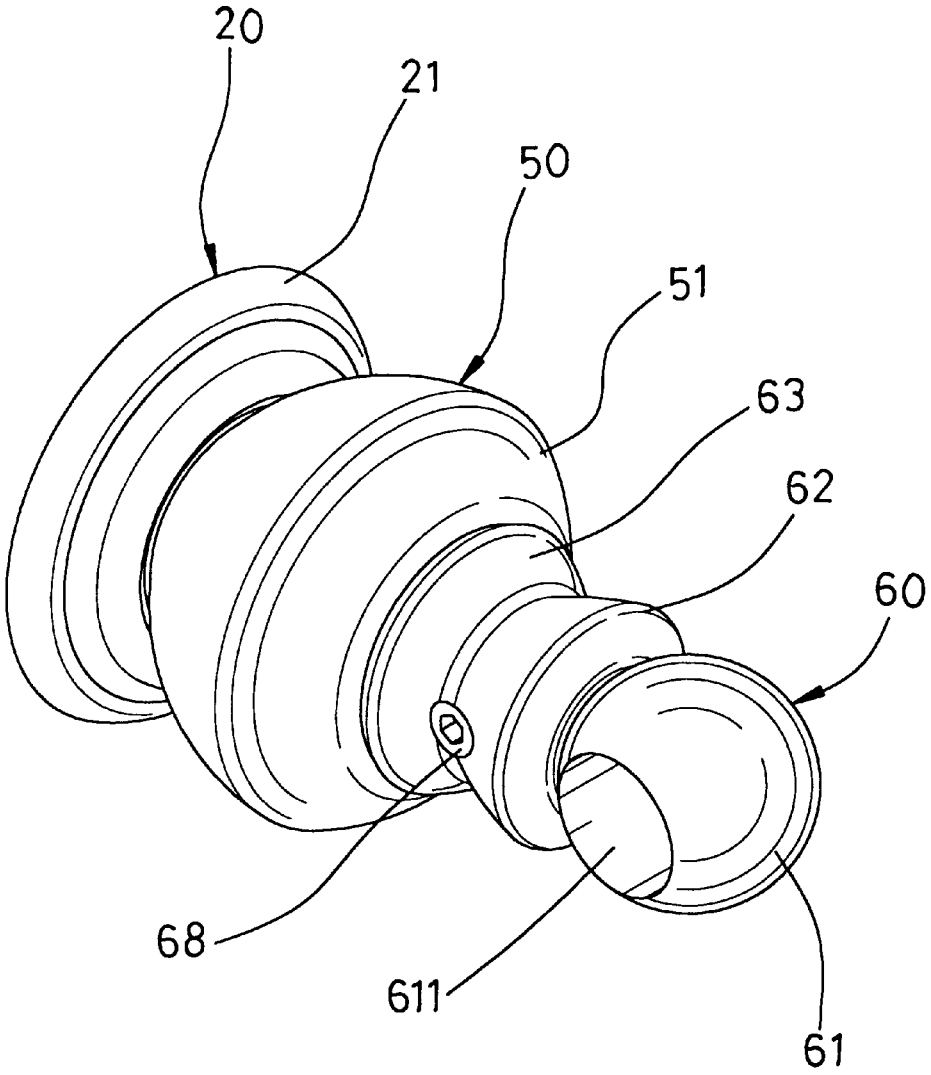
FIG. 4 is a perspective view of the preferred embodiment.

In assembly, referring to FIGS. 4 and 5, a screw fixture 80 (see FIG. 3) is first inserted into the upright wall, and the screw fastener 70 is passed through the inner proximate annular wall 251 of the positioning plate 20 from the inner distal annular wall 25 to engage threadedly the screw fixture 80 so as to fix the positioning plate 20 on the upright wall. An adhesive sheet 230 may be attached between the positioning plate 20 and the upright wall. Then, the mounting portion 31 of the mounting post 30 engages threadedly the inner distal annular wall 25 to abut against the screw fastener 70.

Subsequently, the waterproof member 40 is passed through the shell member 50 from the distal neck portion 51 toward the proximate neck portion 53 such that the distal neck portion 51 engages the neck portion 42 for connecting the waterproof member 40 and the shell member 50. The proximate and distal ends 44,41 project outwardly of the proximate and distal neck portions 53,51. In addition, the waterproof member 40 is sleeved on the stem portion 35 of the mounting post 30 such that the proximate end 44 engages sealingly the central area 24 of the positioning plate 20. At this time, there is a clearance 500 formed between the proximate neck portion 53 and the central area 24.

Finally, the holding member 60 is sleeved on the guiding and anchoring portions 34,32 by means of the axial hole 66 to conceal the anchoring portion 32, and the annular protrusion 64 is received in the proximate annular recess 47 of the waterproof member 40 such that the anchoring portion 32 is aligned with the screw hole 67 in the radial direction. The distal end 41 is engaged sealingly with the annular groove 65. There is also a clearance 501 formed between the distal neck portion 51 and the skirt portion 63. Moreover, the fastening member 68 is inserted threadedly into the screw hole 67, and a tip end 681 thereof is tightened with the anchoring portion 32 so as to fix the mounting post 30 relative to the holding member 60.

As mentioned above, since the mounting post 30 is inserted into the waterproof member 40 to engage tightly the protruding post 22 and the holding member 60, and since the waterproof member 40 engages sealingly the positioning plate 20 and the holding member 60, the holding member 60 is secured to the positioning plate 20 very firmly so as to prevent swaying during use. In addition, by means of the waterproof member 40, the fitting of this invention, especially the fastening member 70, can be protected from moisture.

It is noted that only one fastening member 70 is needed to fix the positioning plate 20 on the upright wall, thereby resulting in convenient assembling of the fitting.

Figure 6:
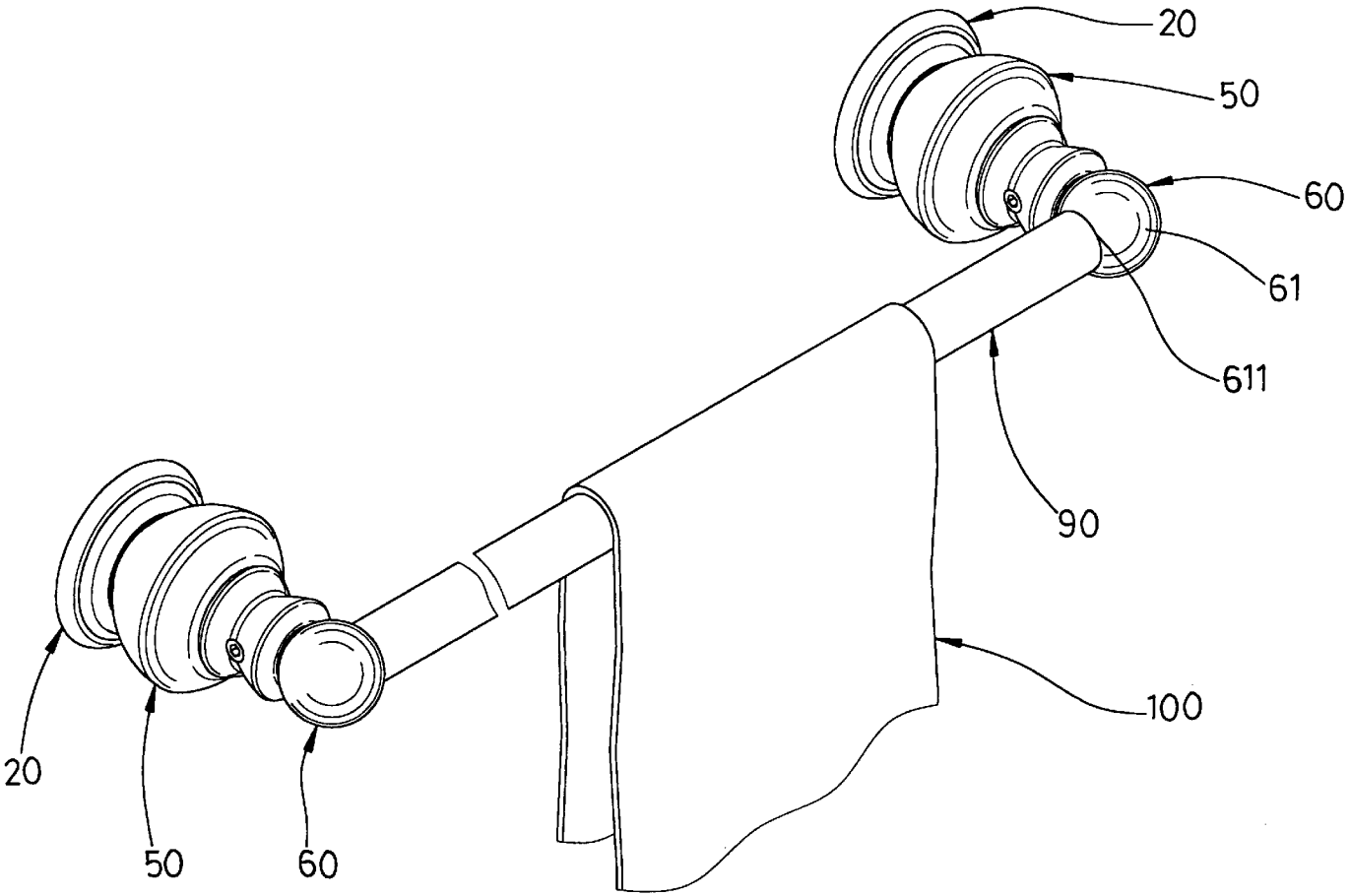
FIG. 6 illustrates how the preferred embodiment of this invention is used for holding a support member in the form of a transverse rod such that the assembly serves as a washcloth rack.

Referring to FIG. 6, when two fittings of this invention are mounted on an upright wall, two ends of a support member in the form of a transverse rod 90 can be held within the holding holes 611 such that a washcloth 100 can be hung on the transverse rod 90.

Figure 7:
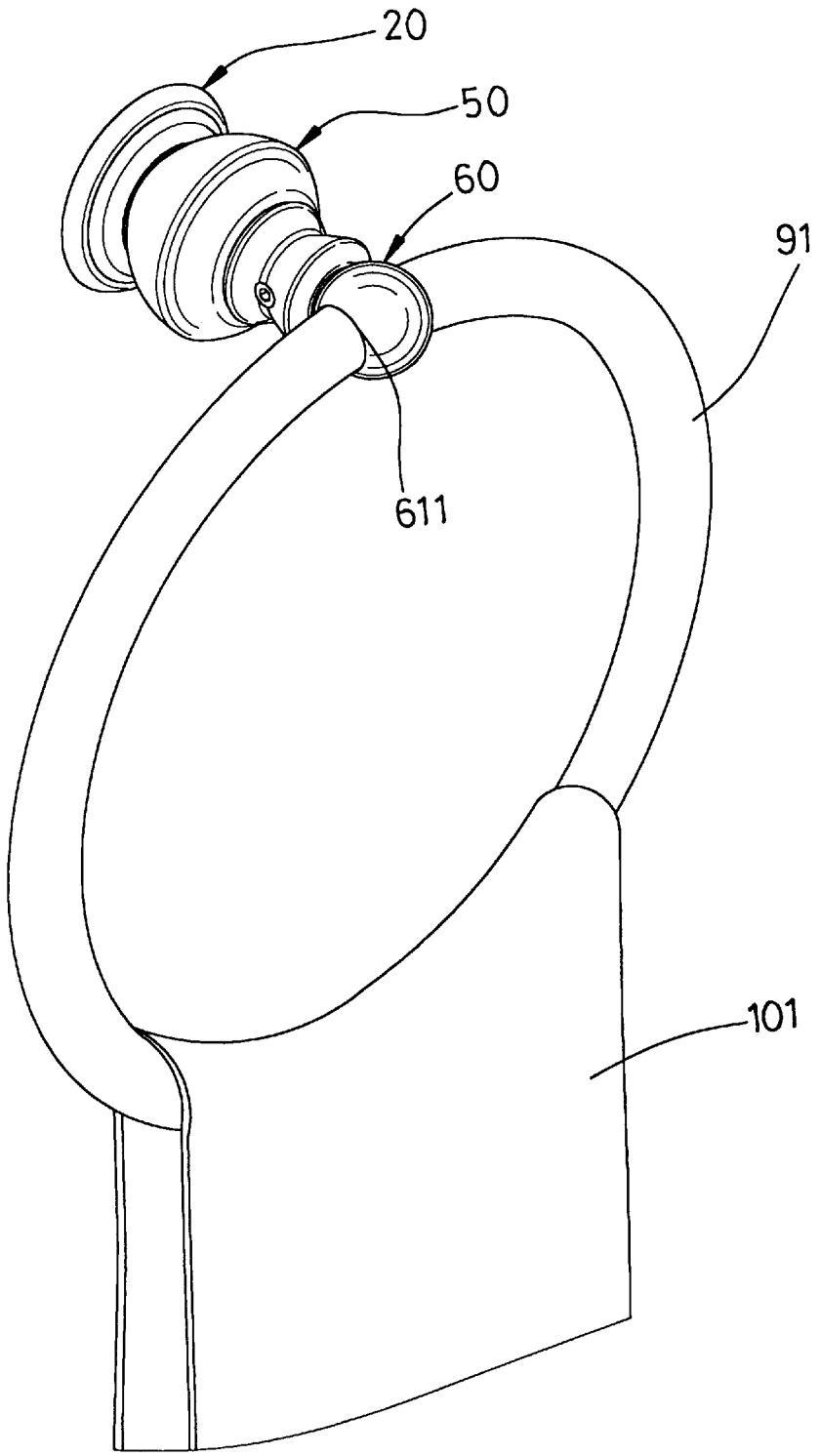
FIG. 7 illustrates how the preferred embodiment is used for holding another support member in the form of a ring such that the assembly serves as a towel rack.

Referring to FIG. 7, a support member in the form of a holding ring 91 can be held in the holding hole 611 of the fitting for hanging a towel 101 thereon.

Figure 8:
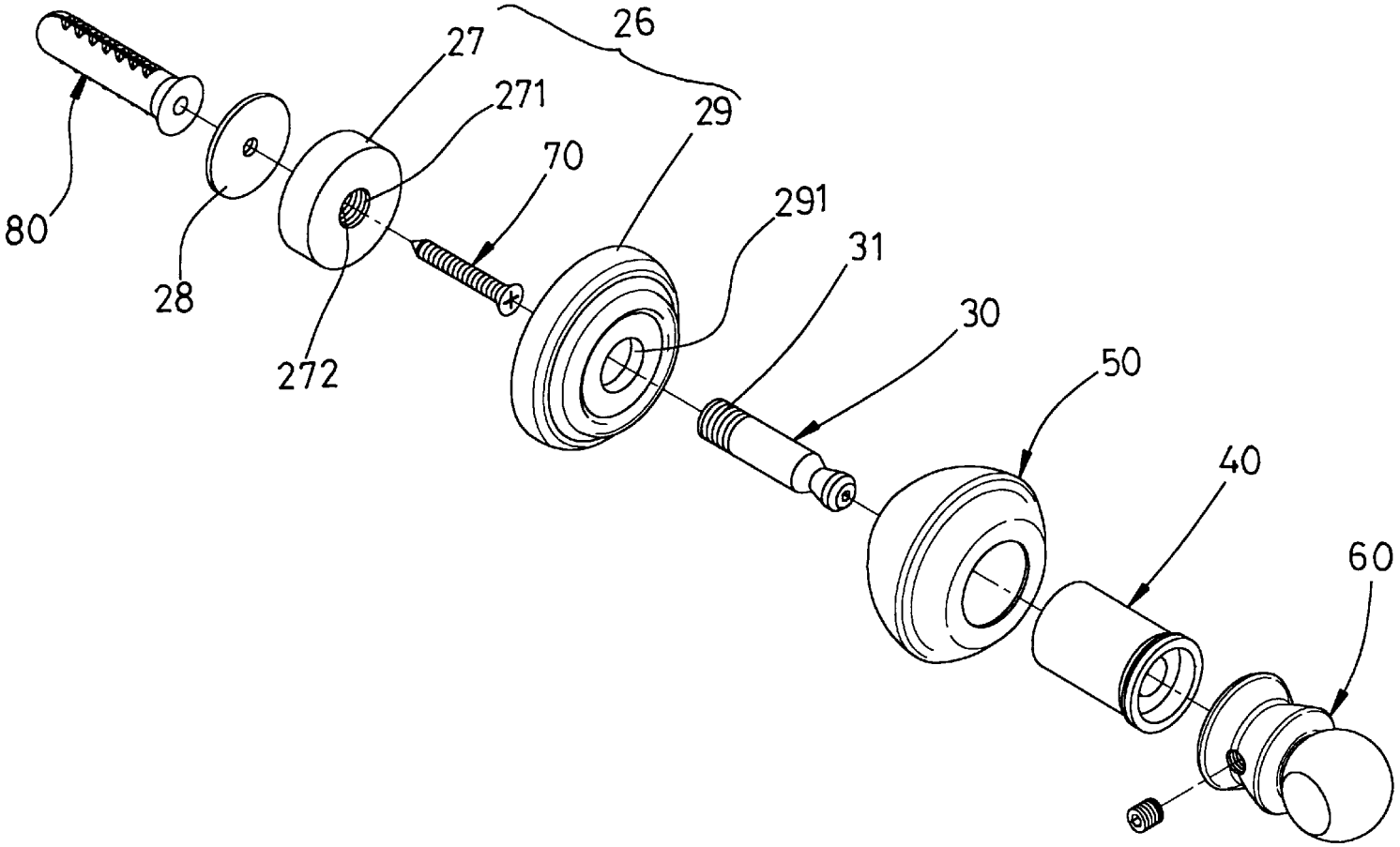
FIG. 8 is an exploded view of another preferred embodiment according to this invention.
Figure 9:
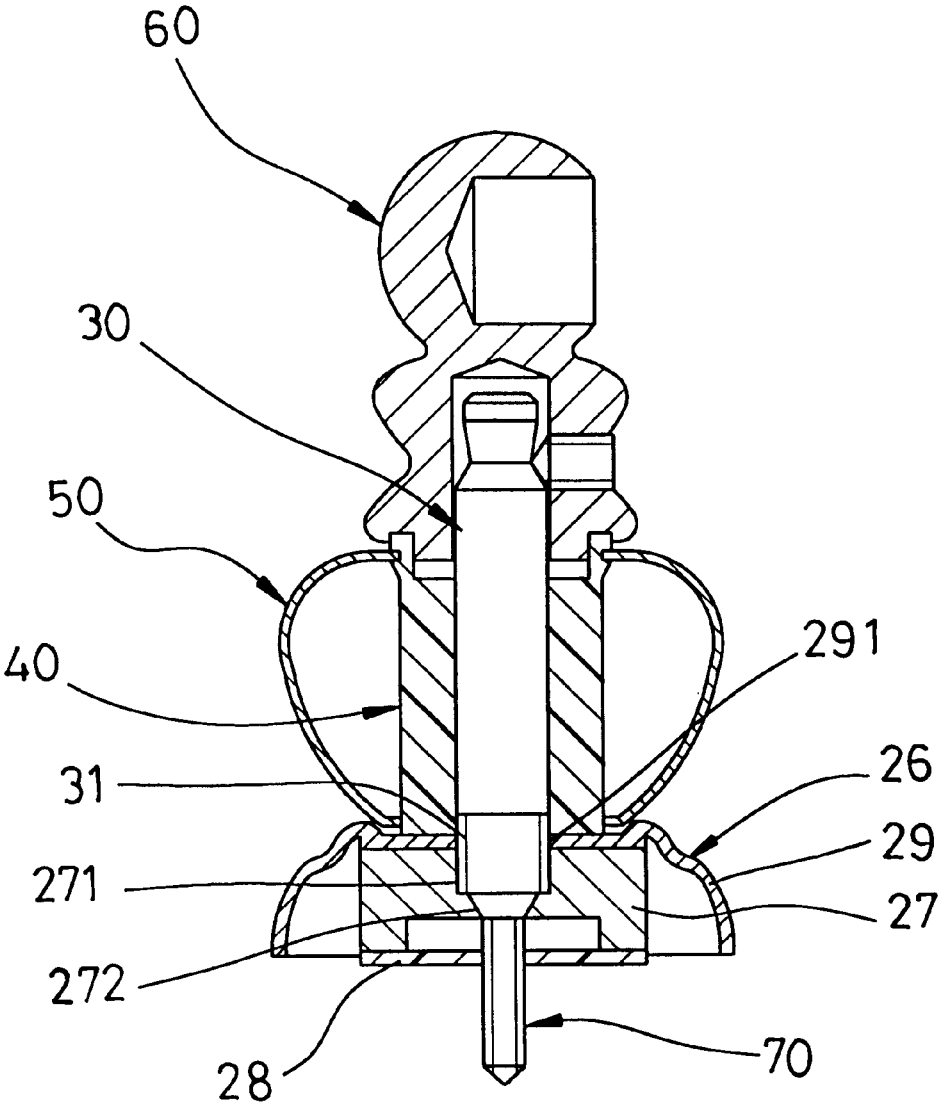
FIG. 9 is a sectional view of the preferred embodiment shown in FIG. 8.

Referring to FIGS. 8 and 9, another preferred embodiment of the fitting according to this invention is shown to include a positioning plate 26 which differs from the aforementioned embodiment in that the positioning plate 26 includes a positioning shell 29 and a positioning seat 27 which is received in the positioning shell 29. The positioning shell 29 has a through hole 291 for passage of the mounting post 30. The positioning seat 27 has the inner distal annular wall 271 and the inner proximate annular wall 272. A washer 28 is disposed between the positioning seat 27 and an upright wall (not shown) so as to secure the fastening member 70 onto the upright wall.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A fitting adapted for holding spacedly a support member on an upright wall, comprising:

a positioning plate adapted to be fixed on the upright wall, and having an outer major wall which serves as a faceplate and which includes a central area defining a bore that extends from said outer major wall in an axial direction towards the upright wall, said bore having an inner distal annular wall tapped and proximate to said outer major wall, and an inner proximate annular wall opposite to said inner distal annular wall in said axial direction and defining a bottom hole adapted for fixing said positioning plate on the upright wall along said axial direction;

a mounting post elongated in said axial direction, and having a mounting portion with a threaded outer surface for threadedly engaging said inner distal annular wall to conceal said bottom hole so as to form an integrity of the faceplate with said outer major wall, a guiding portion distal to said outer major wall, an anchoring portion interposed between said mounting and guiding portions, and a stem portion interposed between said mounting and anchoring portions;

a holding member having an axial hole to receive rotatably said guiding and anchoring portions, a skirt portion disposed to be proximate to and capable of being brought to conceal said anchoring portion, and a holding portion distal to said anchoring portion and adapted to hold the support member;

a fastening member disposed to fix said holding member relative to said anchoring portion by tightening along a radial direction relative to said axial direction;

a hollow annular waterproof member sleeved on said mounting post, and having proximate and distal ends in said axial direction and respectively and sealingly engaging said central area of said positioning plate and said skirt portion of said holding member, and an axial hole extending in said axial direction for passage of said mounting post; and an annular shell member having proximate and distal neck portions opposite to each other in said axial direction and respectively provided with proximate and distal engaging inner walls to engage said waterproof member separately, and with a length extending between said two engaging inner walls and slightly smaller than that of said waterproof member.

2. The fitting as claimed in claim 1, wherein said waterproof member further has a distal annular recess extending inwardly of said distal end in said axial direction and having a dimension larger than that of said axial hole of said waterproof member;

said holding member further having an annular protrusion extending from said skirt portion in said axial direction distal to said holding portion and received in said distal annular recess of said waterproof member.

3. The fitting as claimed in claim 1, wherein said waterproof member further has a proximate annular recess extending inwardly of said proximate end in said axial direction and having a dimension larger than that of said axial hole of said waterproof member;

said positioning plate further having a protruding post which has said inner distal annular wall and which extends in said axial direction from said central area so as to be received in said proximate annular recess of said waterproof member.

4. The fitting as claimed in claim 1, wherein said holding member has a holding hole formed therethrough and extending in a direction transverse to said axial direction.

5. The fitting as claimed in claim 1, wherein said holding member further has a screw hole extending in said radial direction and communicated with said axial hole for threaded passage of said fastening member to fix said holding member relative to said anchoring portion.

* * * * *